US006318162B1

(12) United States Patent
Seok

(10) Patent No.: US 6,318,162 B1
(45) Date of Patent: Nov. 20, 2001

(54) WATER TEMPERATURE CORRECTION DEVICE AND METHOD THEREOF FOR ENGINE

(75) Inventor: Jin-Tae Seok, Suwon (KR)

(73) Assignee: Hyundai Motor Company, Seoul (KR)

( * ) Notice: Subject to any disclaimer, the term of this patent is extended or adjusted under 35 U.S.C. 154(b) by 0 days.

(21) Appl. No.: 09/451,349

(22) Filed: Dec. 3, 1999

(30) Foreign Application Priority Data

Jul. 8, 1999 (KR) ..... 99-27526

(51) Int. Cl.[7] ..... G01M 15/00
(52) U.S. Cl. ..... 73/118.1
(58) Field of Search ..... 73/116, 117.2, 73/117.3, 118.1; 340/449, 438, 425.5; 701/99, 100

(56) References Cited

U.S. PATENT DOCUMENTS 4,682,493 * 7/1987 Tenenbaum ..... 73/118.1
5,239,865 * 8/1993 Salzer et al. ..... 73/292
5,295,747 * 3/1994 Vinci ..... 73/756
5,656,771 * 8/1997 Beswick et al. ..... 73/117.3
6,055,470 * 4/2000 Londot et al. ..... 73/116
6,088,661 * 7/2000 Poublon ..... 73/118.2
6,128,948 * 10/2000 Shi et al. ..... 73/117.2
6,200,021 * 3/2001 Mitsutani et al. .

* cited by examiner

*Primary Examiner*—Eric S. McCall
(74) *Attorney, Agent, or Firm*—Birch, Stewart, Kolasch & Birch, LLP

(57) ABSTRACT

A water temperature correction device and method thereof controls operation of an internal combustion engine by determining when a water temperature sensed is higher than a predetermined reference value, to accurately perform control of an internal combustion engine regardless of external influences. A water temperature sensor detects a temperature of cooling water in an internal combustion engine. A microcomputer receives the water temperature value detected by the water temperature sensor to determine whether the received water temperature value is above a predetermined reference value, and outputs a corrected control signal when it is determined that the detected water temperature is above the predetermined reference value.

4 Claims, 3 Drawing Sheets

WATER TEMPERATURE CORRECTION DEVICE AND METHOD THEREOF FOR ENGINE

BACKGROUND OF THE INVENTION

1. Field of the Invention

The present invention relates to an internal combustion engine, and more particularly to a water temperature correction device and method thereof for an engine adapted to accurately control an internal combustion engine by correcting a characteristic curve of water temperature when the temperature of detected cooling water is high as compared to a reference value.

2. Description of the Prior Art

Generally, one of the most essential parameters in the control of an internal combustion engine is the temperature of cooling water. The temperature of cooling water detected by a water temperature sensor is input to a correction device according to a control signal output from the microcomputer.

Information representing the water temperature input to the correction device is used for various controls necessary for driving an internal combustion engine such as ignition time control, idle speed control, fuel injection control and the like.

FIG. 4 is an interface circuit diagram of a correction device for detecting a temperature of cooling water according to the prior art, where the information detected by the water temperature sensor passes a first resistor (R5) used as 5V pull-up resistor via an RC filter 24 comprising a second resistor (R7) and a first capacitor (C1) to be input to a microcomputer after being filtered, and is controlled by a previously set-up program.

At this point, the water temperature information from the water temperature sensor has a water temperature sensor characteristic curve, as illustrated in FIG. 5, and is stored in a memory of the correction device at a map table.

However, there is a problem in that the 5V pull-up resistor at the interface circuit for receiving the water temperature information detected by the water temperature sensor is fixed at a predetermined value, such that the detected water temperature has a wide width in water temperature change when the water temperature is high, whereas the detected voltage value is small. Thus, it is impossible to accurately control of the internal combustion engine by external influence.

SUMMARY OF THE INVENTION

Accordingly, the present invention solves the aforementioned problem and it is an object of the present invention to provide a water temperature correction device and method thereof for an engine, adapted to add circuitry for correction of the water temperature, to an interface circuit when a water temperature information detected and received from a water temperature sensor is higher than a predetermined reference value, thereby enabling an accurate control of an internal combustion engine regardless of external influence when the water temperature is high.

In accordance with one object of the present invention, there is provided a water temperature correction device for an engine comprising:

a water temperature sensor for detecting a temperature of cooling water in an internal combustion engine;

a microcomputer for receiving a water temperature value detected by the water temperature sensor to determine whether the received water temperature value is above a predetermined reference value, and for outputting a predetermined correction control signal when it is determined that the detected water temperature is above the predetermined reference value; and correction means mounted within an interface circuit controlled by the predetermined correction control signal output from the microcomputer for correcting the water temperature value detected by the water temperature sensor and for supplying the corrected water temperature value to the microcomputer.

In accordance with another object of the present invention, there is provided a water temperature correction method for an engine, comprising the steps of:

receiving the water temperature value detected by the water temperature sensor to determine whether the value is higher than a predetermined set-up reference temperature;

outputting a predetermined correction control signal when it is determined that the detected water temperature value is higher than the predetermined set-up reference temperature; and receiving the water temperature value corrected by the predetermined correction control signal to establish a voltage value stored per temperature in a map table in a memory for control thereof.

BRIEF DESCRIPTION OF THE DRAWINGS

For fuller understanding of the nature and objects of the invention, reference should be made to the following detailed description taken in conjunction with the accompanying drawings in which.

DETAILED DESCRIPTION OF THE INVENTION

Preferred embodiments of the present invention thus constructed will now be described in detail with reference to the accompanying drawings.

Figure 1:
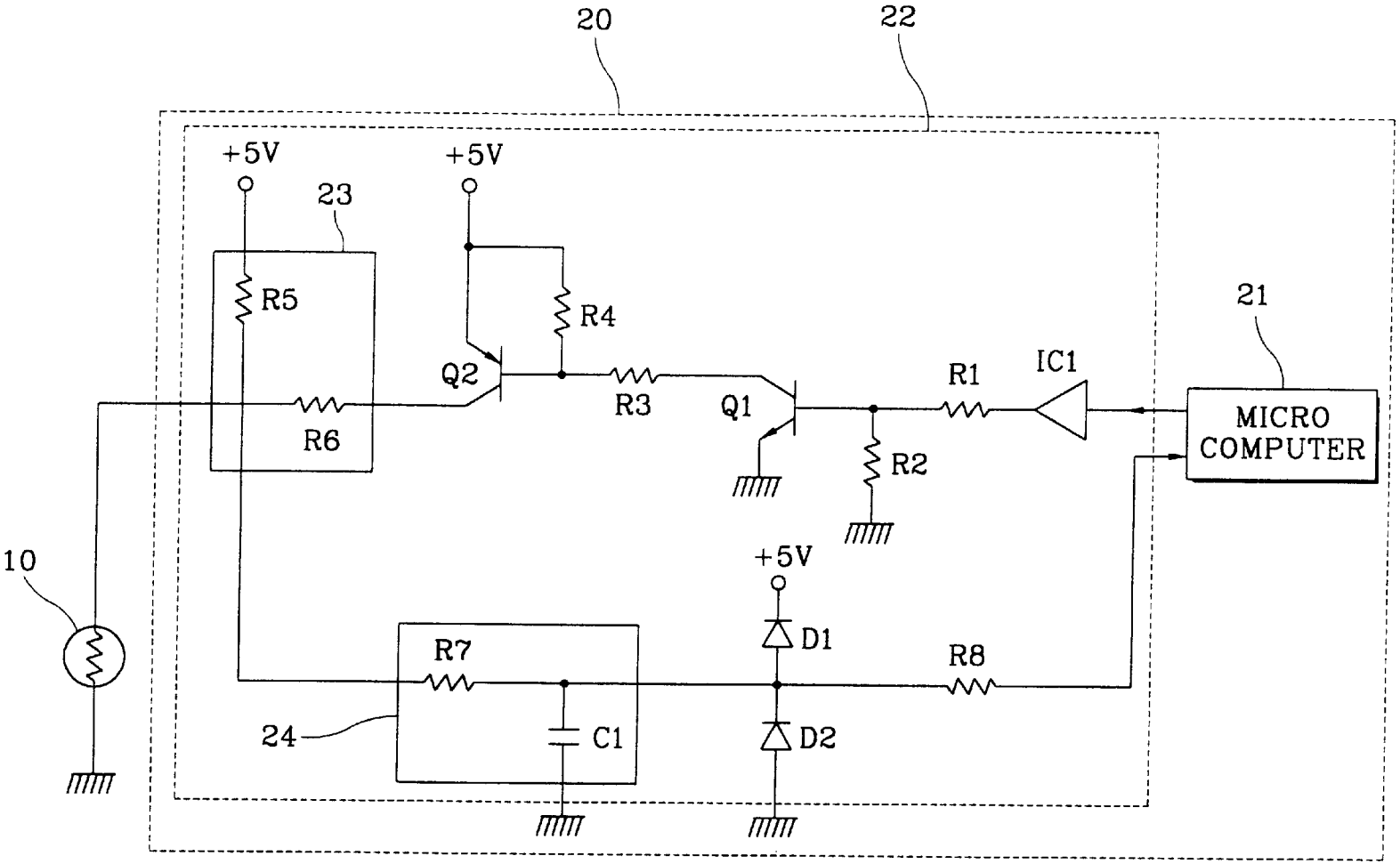
FIG. 1 is a circuit diagram for illustrating a construction of a water temperature correction device in an internal combustion engine according to the present invention.

FIG. 1 is a circuit diagram illustrating a construction of a water temperature correction device in an internal combustion engine according to the present invention, wherein the device includes a water temperature sensor 10 for detecting a temperature of cooling water in an internal combustion engine; a microcomputer 21 for receiving a water temperature value detected by the water temperature sensor 10 to determine whether the received water temperature value is above a predetermined reference value, and for outputting a predetermined correction control signal when it is determined that the detected water temperature is above the predetermined reference value; and a correction device 20 combined with an interface circuit 22 controlled by the predetermined correction control signal output from the microcomputer 21 for correcting the water temperature value detected by the water temperature sensor 10 and for applying the corrected water temperature value to the microcomputer 21.

The interface circuit 22 includes a first signal amplifier (IC1) for amplifying the predetermined correction control signal output from the microcomputer 21, a first transistor (Q1) applying an electric current interdicted by the correction control signal output from the first signal amplifier (IC1), a second transistor (Q2) controlled by actuation and interdiction of the first transistor (Q1), a voltage divider 23 having a fifth resistor (R5) and a sixth resistor (R6) connected in parallel, whose voltage division is determined by the control state of the second transistor (Q2), and a RC filtering unit 24 having a seventh resistor (R7) and a first capacitor (C1) connected in parallel for filtering the value detected by the water temperature sensor 10.

Figure 2:
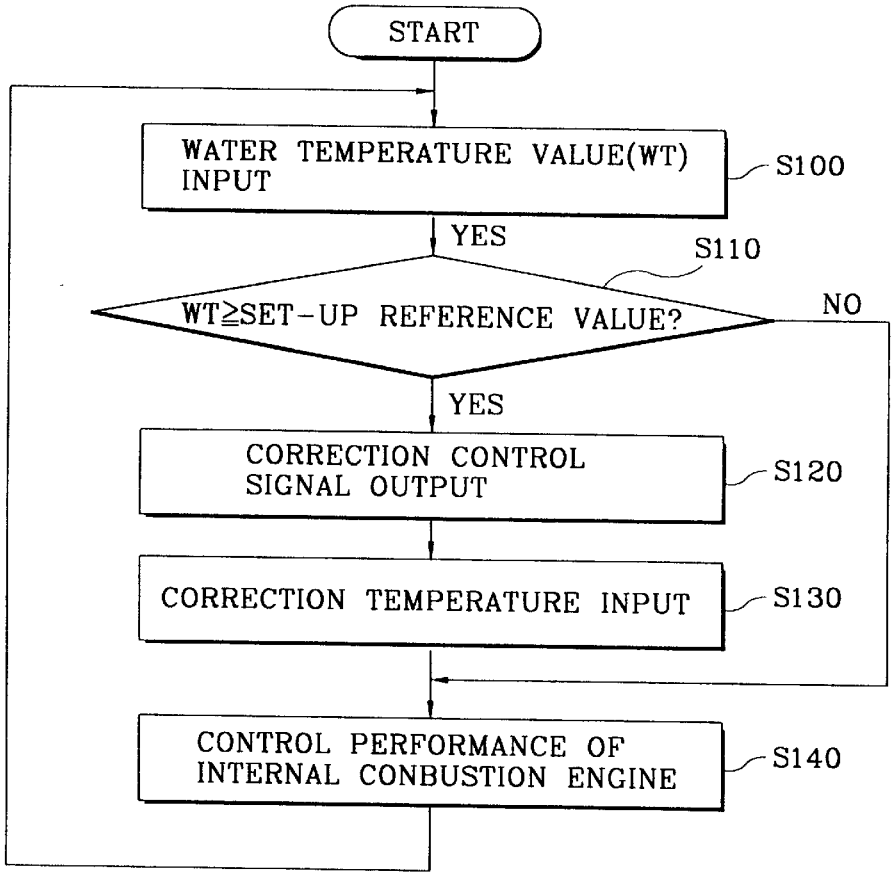
FIG. 2 is an operational flow chart of water temperature correction method in an internal combustion engine according to the present invention.

FIG. 2 is an operational flow chart of water temperature correction method in an internal combustion engine according to the present invention, wherein the method comprises the steps of: inputting a water temperature value (WT) received from the water temperature sensor 10, step S100; determining whether the water temperature value (WT) is larger than a predetermined set-up reference value, step S110; outputting a predetermined correction control signal when it is determined that the water temperature value (WT) input as a result of the determination of a higher than the predetermined set-up reference value, step S120; inputting a water temperature value (WT1) corrected by the predetermined correction control signal, step S130; and converting the input correction water temperature value (WT1) to a voltage and performing a control on the internal combustion engine according to the converted voltage value to return to an initial step of inputting the water temperature value (WT), step S140.

Figure 3:
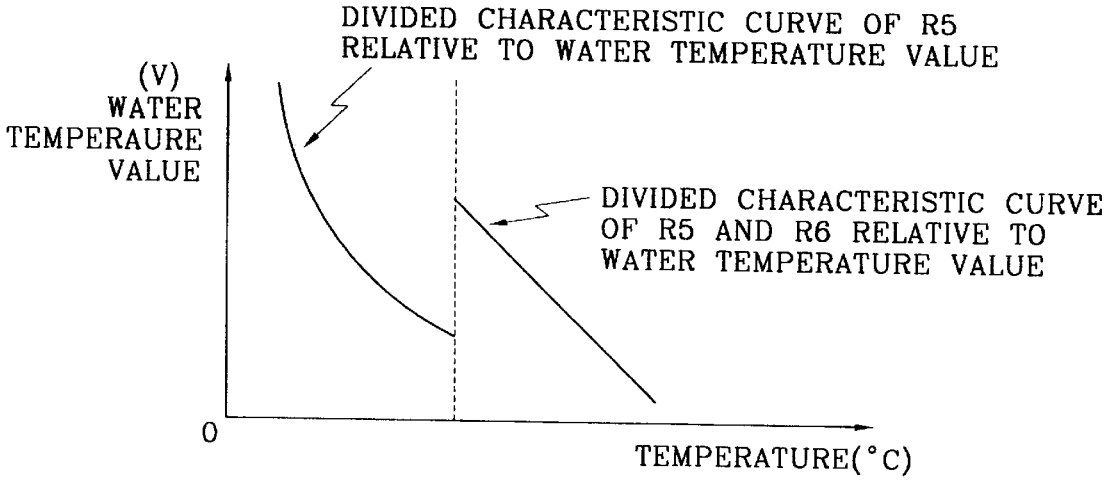
FIG. 3 is a graph depicting a water temperature correction characteristic curve of an internal combustion engine according to the present invention.
Figure 4:
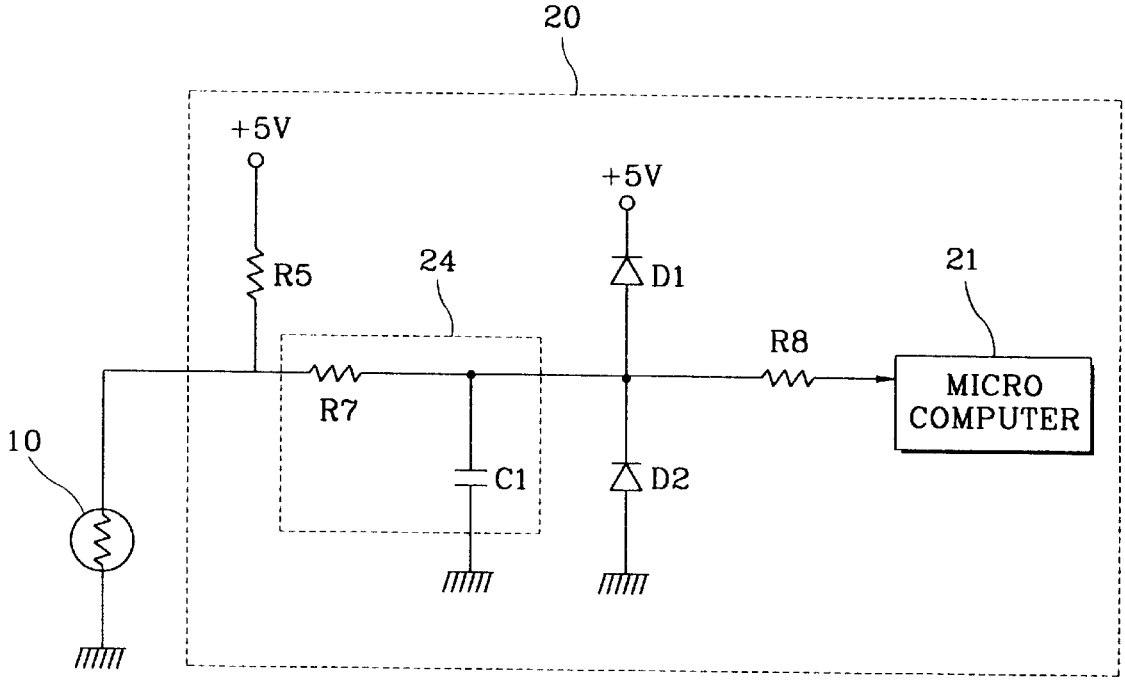
FIG.4 (PRIOR ART)
FIG. 4 is a circuit diagram of a water temperature correction device of an internal combustion engine according to the prior art.
Figure 5:
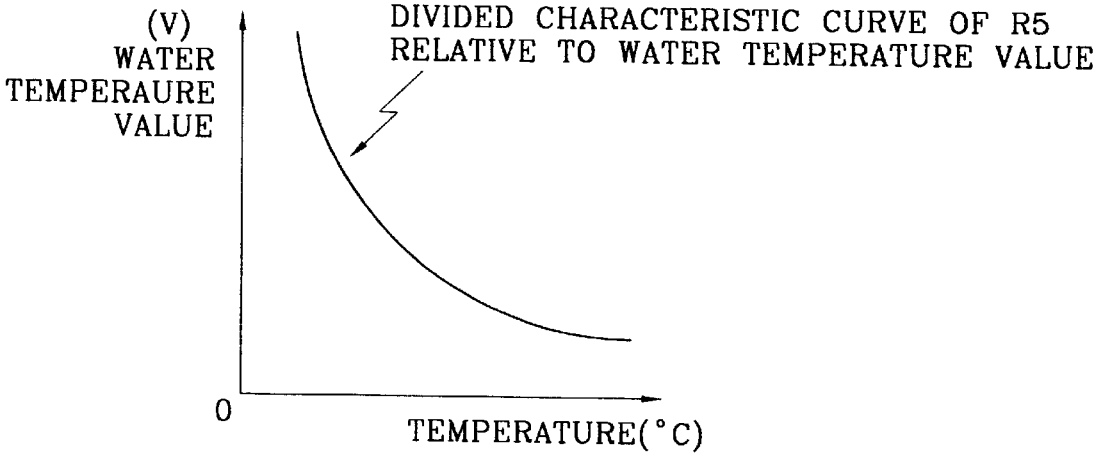
FIG.5 (PRIOR ART)
FIG. 5 is a graph for illustrating a divided pressure characteristic curve of an input resistor in the circuit of FIG. 4 depicting water temperature values vs. temperature changes.

FIG. 3 is a graph depicting a water temperature correction characteristic curve of an internal combustion engine according to the present invention. Now, the correction method of the water temperature correction device in an internal combustion engine thus constructed will be described, wherein reference numeral prefix S stands for "steps".

The microcomputer 21 in the correction device 20 for controlling the internal combustion engine of a vehicle receives the water temperature value (WT) input from the water temperature sensor 10 while the vehicle is running, step S100.

Successively, the microcomputer 21 determines whether the input water temperature value (WT) is higher than a predetermined set-up reference value (by way of example, 60), step S110. If it is determined as a result of the determination at step S100 that the water temperature value (WT) input from the water temperature sensor 10 is higher than the predetermined set-up reference value, the microcomputer 21 outputs a predetermined correction control signal to the interface circuit 22, step S120. The interface circuit 22 then amplifies at the first amplifier (IC1) a "high" signal which is the predetermined correction control signal output from the microcomputer 21. The correction control signal amplified by the first amplifier (IC1) is reduced in voltage thereof by the first resistor (R1) and the second resistor (R2) to thereafter control the first transistor (Q1).

When the first transistor (Q1), a PNP type transistor, is activated by the correction control signal, voltage of +5V is reduced in voltage thereof to a predetermined value via the fourth resistor (R4) and the third resistor (R3) to be applied to a collector terminal and to flow in an emitter terminal connected to the circuit.

At this time, a base terminal of the second transistor (Q2) connected between the fourth resistor (R4) and the third resistor (R3) becomes "low".

The second transistor (Q2), an NPN type transistor, becomes activated when a "low" signal is applied to the base terminal of the second transistor (Q2) connected between the fourth resistor (R4) and the third resistor (R3).

Successively, the water temperature value (WT) detected by the water temperature sensor 10 is corrected on a divided ratio by the voltage divider 23 connected in parallel by the fifth resistor (R5) and the sixth resistor (R6).

The water temperature value (WT1) thus corrected is applied to the microcomputer (21) through the RC filtering unit 24 connected in parallel by the seventh resistor (R7) and the first capacitor (C7).

Successively, the microcomputer 21 receives the water temperature value (WT1) corrected by the interface circuit 22, step S130 to establish a voltage value according to the water temperature value at the map table in the memory corresponding to a characteristic curve according to the divided voltage by the fifth resistor (R5) and the sixth resistor (R6) relative to the water temperature value as illustrated in FIG. 3, and performs a driving control of the internal combustion engine according to the set-up voltage value and simultaneously returns to the initial step (S100) for inputting the water temperature value (WT), step S140.

However, if it is determined that the water temperature value (WT) detected by the water temperature sensor (step S110) is below the predetermined set-up reference value, the microcomputer 21 establishes a voltage value according to the water temperature value at the map table in the memory corresponding to the characteristic curve according to the divided voltage by the fifth resistor (R5) and the water temperature sensor illustrated in FIG. 3 to perform the driving control of the internal combustion engine.

Accordingly, driving of the internal combustion engine can be accurately controlled regardless of external influences even at high water temperatures because the characteristic curve is adjusted for establishing a voltage value according to the value from the water temperature sensor detected on the basis of the predetermined set-up reference temperature value.

As apparent from the foregoing, there is an advantage in the water temperature correction device and method thereof for an engine according to the present invention thus described in that a characteristic curve is adjusted based on a predetermined set-up reference to use the existing current characteristic curve, if a water temperature detected by a water temperature sensor is below a predetermined set-up reference value, and to use a characteristic curve if the water temperature detected by the water temperature sensor is higher than the predetermined set-up reference value, thereby controlling a driving state of an internal combustion engine according to the set-up voltage value to further accurately control the driving state of the internal combustion engine.

What is claimed is:

1. A water temperature correction device for an engine comprising:

a water temperature sensor for detecting a temperature of cooling water in an internal combustion engine;

a microcomputer for receiving a water temperature value detected by the water temperature sensor to determine whether the received water temperature value is above a predetermined reference value, and for outputting a predetermined correction control signal when it is determined that the detected water temperature is above the predetermined reference value; and correction means combined with an interface circuit controlled by the predetermined correction control signal output from the microcomputer for correcting the water temperature value detected by the water temperature sensor and applying the corrected water temperature to the microcomputer.

2. The device as defined in claim 1, wherein the interface circuit comprises:

a first signal amplifier for amplifying the predetermined correction control signal output from the microcomputer;

a first transistor applying an electric current of the correction control signal output from the first signal amplifier;

a second transistor controlled by actuation of the first transistor;

a voltage divider, the voltage division of which is determined by the control state of the second transistor; and an RC filtering unit for filtering the value detected by the water temperature sensor.

3. A water temperature correction method for an engine, comprising the steps of:

receiving a water temperature value detected by a water temperature sensor to determine whether the value is higher than a predetermined set-up reference temperature;

outputting a predetermined correction control signal when the detected water temperature value is higher than the predetermined set-up reference temperature; and utilizing the water temperature value corrected by the predetermined correction control signal to establish voltage values stored by temperatures in a map table in a memory for generating a corrected control signal.

4. The method as defined in claim 3, further comprising the steps of establishing a voltage value according to a water temperature value detected from the map table in the memory to perform a driving control of an internal combustion engine when determined the water temperature value is below a predetermined set-up reference value.

* * * * *